United States Patent [19]

Frostig

[11] 4,413,567

[45] Nov. 8, 1983

[54] FIN-STABILIZED MORTAR GRENADE

[75] Inventor: Amos Frostig, Haifa, Israel

[73] Assignee: Etablissement Salgad, Vaduz, Liechtenstein

[21] Appl. No.: 185,041

[22] Filed: Sep. 8, 1980

[30] Foreign Application Priority Data

Sep. 8, 1979 [DE] Fed. Rep. of Germany ..... 2936408

[51] Int. Cl.[3] ..... F42B 31/00

[52] U.S. Cl. ..... 102/525; 102/372; 102/473

[58] Field of Search ..... 102/372, 373, 524, 525, 102/526, 527, 528, 473, 520–523; 89/26

[56] References Cited

U.S. PATENT DOCUMENTS

| | | | |
|---|---|---|---|
| 1,861,522 | 6/1932 | Brandt | 102/527 |
| 3,143,074 | 4/1964 | Jasse | 102/525 |
| 3,613,596 | 10/1971 | Walde | 102/525 |
| 3,687,079 | 8/1972 | Scollins | 102/373 |
| 3,731,627 | 5/1973 | Donner | 102/373 |

*Primary Examiner*—Harold J. Tudor

*Attorney, Agent, or Firm*—Neil F. Markva

[57] ABSTRACT

A fin-stabilized mortar grenade has an ogival shell body, a tail tube with finned controlling surfaces. The shell body has at least one annular groove located with the limits of the caliber diameter zone. A spreadable sealing ring is disposed in the annular groove. The sealing ring has an edge bevel located at the edge facing the shell body at the bottom of the annular groove. The bevel edge configuration provides a mechanism by which the force of propellant gases enhances the radial spreading of the sealing ring outwardly against the inside surface of the barrel from which the mortar grenade is fired.

5 Claims, 4 Drawing Figures

FIN-STABILIZED MORTAR GRENADE

FIELD OF THE INVENTION

This invention relates to fin-stabilized mortar grenades having ogival bodies and a tail tube with controlling surfaces formed on fins. The body includes at least one annular groove within the limits of the caliber diameter zone which is that portion of the body closely juxtaposed the inside surface of the barrel from which the grenade is fired.

BACKGROUND OF THE INVENTION

Fin-stabilized mortar shells are generally fired by inserting them from above into the barrel of the weapon. The fin-stabilized mortar shell or grenade has an ogival body and slips through the barrel as far as the lower end thereof. After ignition of the propellant charge, the shell is propelled out of the barrel. A certain amount of play with comparatively large tolerance is necessary between the zone of greatest diameter of the ogival body and the inside of the diameter of the barrel so that the shell can slide in the barrel with the known type of propelling charge. However, because of the annular clearance around the outside of the caliber diameter zone of the body, the propellant gases in the known devices are capable of passing through forwardly into the free space formed in that annular clearance. Consequently, the propellant gases after passage of the shell through the body cannot contribute to the firing of the shell.

Known fin-stablized shells include annular grooves which have been arranged in the greatest diameter zone or caliber diameter zone to form an eddy zone and thus a baffle effect for the propellent gases arriving from the explosion of the charge. The eddy zone and baffle effect hinders the flow of the propellant gases and thereby prevent the gases from penetrating forwardly of the caliber diameter zone. The baffle effect of the gases also sets up a zone of pressure which slows down the oscillating movement of the shell during its passage through the barrel. The propellant gases may be held back with greater or lesser efficiency through the particular formation of the cross section of the annular grooves.

It is further known to place a sealing ring in the annular groove which is located within the limits of the caliber diameter zone of the shell body. The sealing ring is effective to seal the shell body with respect to the inner wall of the barrel against the propellant gases flowing from behind. Such a known ring is split and therefore is spreadable outwardly against the inner wall of the firearm barrel. Such a prior art sealing ring, however, may not project beyond the greatest diameter of the ogival shell body. Otherwise, difficulties arise with respect to the loading of the shell when attempting to insert it from above into the firearm barrel. Obviously, the loading operation of the mortar barrel must proceed completely in an uninterrupted manner. When the sealing ring is in the relaxed condition, it must not project beyond the outer diameter with the annular groove. This, however, leads to the difficulty of reliability with respect to the spreading of the sealing ring so that the propellant gases acting from behind the ring are effectively held back against their penetration forwardly of the ring.

SUMMARY OF THE INVENTION

The primary object of the invention is to provide a fin-stabilized mortar grenade having an ogival body and a sealing ring disposed in an annular groove within the caliber diameter zone in a manner that is more effective than known heretofore. The spreading ring used in conjunction with the fin-stabilized mortar shell of this invention has an edge bevel at the side facing the rear portion of the shell body and at the surface facing the bottom surface of the annular groove. An edge bevel configuration is also disposed at the side of the annular groove facing the forward shell body portion.

According to another feature of the invention, the annular groove includes a lateral surface extending at an inclination from the bottom surface of the groove toward the rear of the shell body as seen in cross section. The bottom surface of the annular groove may be broader than the width of the sealing ring disposed therein. The edge bevel configuration on the sealing ring allows the entry of the propellant gases to the underside of the sealing ring to considerably facilitate and increase its spreadability. The flow of propellant gases is unobstructed to the underside of the sealing ring so that an immediate outward spreading of the sealing ring is effected. Furthermore, a pressure zone may be built up in the space formed between the sealing ring side facing the rear of the shell body portion and the inclined lateral face of the lateral groove. The pressure of the obstructed propellant gases quickly becomes greater than that of the gases acting on the outer surface of the sealing ring within the pressure zone. Consequently, there is an immediate spreading of the sealing ring, and the sealing of the shell body at the inside wall of the barrel is enhanced. With the thorough and complete sealing of the shell at the inside of the barrel, the passage of propellent gas along the shell jacket is prevented.

In a further feature of the invention, cross slots are formed on the inner surface of the sealing ring and have a depth corresponding to the ring thickness showing the edge bevel. That is, the depth comprehends only the zone of the ring thickness resulting from the edge bevels. The sealing ring may be composed of plastic material and have a high strength and tenacity. The cross slots make such a sealing ring flexible with respect to its spreading movement and at the same time bring about a flowing away of the propellent gases to the sealing ring edge bevel remote from the propellant gases. Thus, thrusting of the sealing ring out of the groove for sealing application to the inside wall of the barrel takes place uniformly and symmetrically.

A further important feature of the invention is directed to the specific arrangement of the annular groove with the sealing ring located within the ogival shell body of the fin-stabilized mortar grenade. The annular groove is located in the rear zone of the caliber diameter cylindrical portion of the mortar shell body.

The structural configuration made in accordance with this invention prevents the penetration of the propellent gases forwardly on the passage of the launched mortar grenade through the barrel, and it is specifically advantageous with respect to a mortar grenade which has a particular three-dimensional design. Such a fin-stabilized mortar shell has a forward portion of its shell body inclusive of the annular groove and has a length that is less than twice the value of the caliber diameter. The caliber diameter zone is defined by a cylindrical portion of the shell body with the annular groove arranged in the forward portion of the length of the shell body. The total length of the grenade or mortar shell inclusive of the tail tube may have a length that is from about 5.5 to 5.85 times the caliber diameter.

BRIEF DESCRIPTION OF DRAWINGS

Other objects of this invention will appear in the following description and appended claims, reference being made to the accompanying drawings forming a part of the specification wherein like reference characters designate corresponding parts in the several views.

Figure 1:
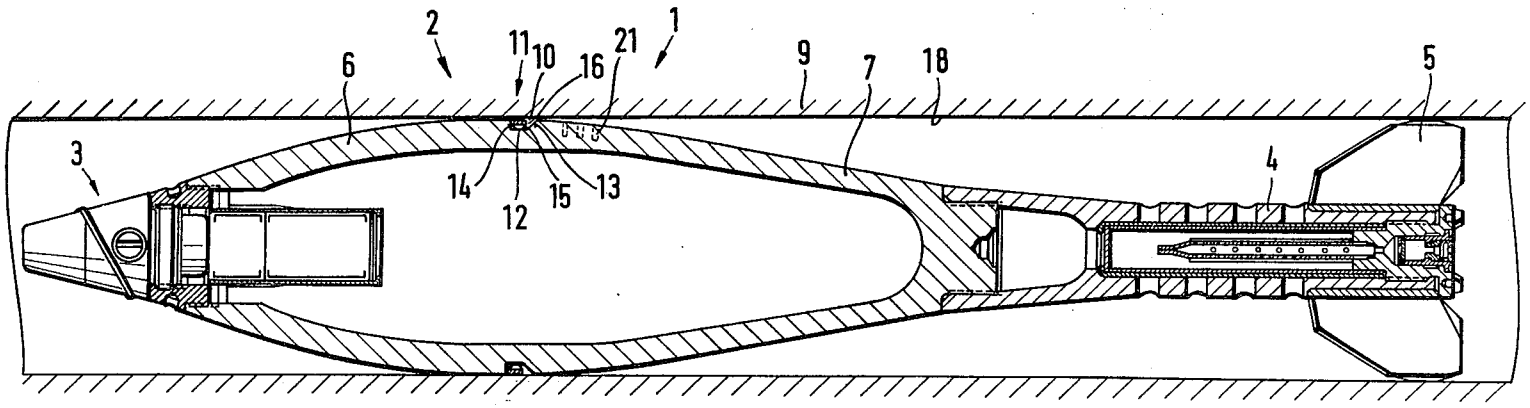
FIG. 1 is a diagrammatic view partially in longitudinal section of a fin-stabilized mortar grenade made in accordance with the invention.
Figure 2:
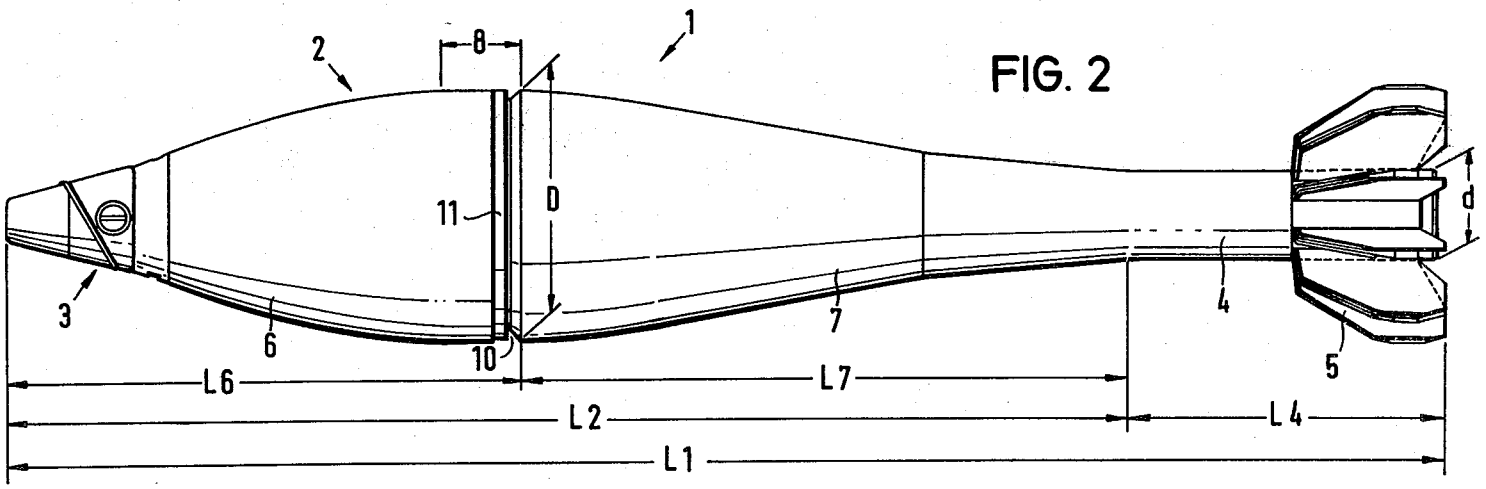
FIG. 2 is a diagrammatic elevational view of the grenade of FIG. 1.

The fin-stabilized mortar grenade, generally designated 1, has an ogival shell body 2, a detonator 3, and a tail tube 4 with finned tail unit 5. The ogival shell body 2 includes a forward shell body portion 6 and a rear shell body portion 7, which portions slope off ogivally forwardly and rearwardly from the middle of body 2. The forward shell body portion 6 includes a cylindrical zone 8 which conforms in diameter to the caliber diameter D of the grenade or shell 1. The fin-stabilized shell or grenade 1 is inserted from above the mortar barrel 9 from which it is discharged. Tail tube 4 has a diameter d.

A sealing ring 11 is disposed in a groove 10 which is located in the rear portion of the cylindrical zone 8 of the forward shell body portion 6. In this embodiment, the annular groove 10 includes a bottom 12 having a width greater than the width of the sealing ring 11. Furthermore, annular groove 10 has an inclined lateral face 13 directed from the bottom face 12 to the rear portion 7 of shell body 2. Annular groove 10 also includes a lateral face 14 extending at right angles to the longitudinal axis of shell body 2 at the side of groove 10 disposed toward the forward shell body portion 6.

Figure 3:
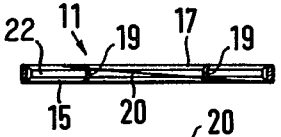
FIG. 3 is a diagrammatic sectional view of a sealing ring made in accordance with the invention.
Figure 4:
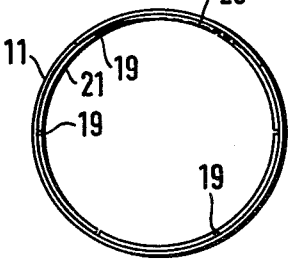
FIG. 4 is a plan view of the sealing ring of FIG. 3.

As shown in FIGS. 3 and 4, sealing ring 11 includes an edge bevel 15 at its lower face 22 which, as shown, is cylindrical and contiguously faces the bottom face 12 of annular groove 10. Edge bevel 15 is turned toward the rear shell body portion 7. Thus, the propellant gases flowing forwardly from the tail tube 4 can flow into the space 16 formed by the inclined face 13 and immediately arrive at the edge bevel 15. Through the flow of propellent gases, in this manner, a force vector is induced radially outwardly onto sealing ring 11. In this embodiment, a further edge bevel 17 is located at the side of sealing ring 11 which faces the forward shell body portion 6. Thus, because of the propellant gases flowing below sealing ring 11, a force vector is also induced from this side of sealing ring 11 and exerted radially outwardly to spread the sealing ring 11 to an expanded position and apply same against the inside wall 18 of barrel 9.

Edge bevels 15 and 17 are advantageously disposed at an angle of 45°. Thus, they extend over a portion of the thickness of sealing ring 11, said portion being over half of said thickness. The inclined face 13 of annular groove 10 is also disposed at an angle of 45°. In some particular cases, this angle of inclination may be a little smaller than 45°.

Cross slots 19 are peripherally spaced along the inner side of sealing ring 11. Slots 19 extend in depth only over the ring thickness showing edge bevels 15 and 17. The cross slots 19 increase the flexibility of the spreadable sealing ring 11 and form passages through the side of sealing ring 11 opposite to the propellant gases flowing toward said side. Thus, sealing ring 11 is uniformly and radially outwardly lifted out of annular groove 10 to ensure a full application of sealing ring 11 with its outer peripheral surface against inside wall 18 of barrel 9. In this embodiment, sealing ring 11 is divided through a separation plane 20 which passes obliquely through ring 11. Separation plane 20 is at an angle of about 3° to 6° with respect to the principal plane of ring 11 which principal plane is normal to the longitudinal axis of ring 11. Thus, adequate sealing is achieved at sealing ring 11 itself when in the spread condition.

Narrow annular grooves 21 indicated in broken lines in FIG. 1, may be located on the rear shell body portion 7 on the tail side of annular groove 10. The disposition of such grooves 21 encourages a build-up of pressure of the inflowing propellant gases in the slit-like annular space between shell body portion 7 and the inside wall 18 of barrel 9.

Fin-stabilized mortar grenade 1 having ogival shell body 2 including annular groove 10 and sealing ring 11 supported therein is formed in a predetermined manner with respect to the ogival development of shell body 2. The total length L1 of mortar grenade 1 is about 5.5 to 5.85 times the caliber diameter D and the length of the forward shell body portion 6 including annular groove 10 should be less than twice the caliber diameter D. The length of forward shell body portion 6 may advantageously be in the range of about 1.75 to 1.95 times the caliber diameter D. With this, the cylindrical shell body zone or portion 8 is still a part of the forward shell body portion 6. Length L2 is about 3.85 to 3.95 times the caliber diameter D, so that the length L7 of rear shell body portion is normally greater than the length L6 of the forward shell body portion 6. The rear shell body portion 7 should slope relatively markedly away to tail tube 4 which has a diameter d which is about 0.3 to 0.35 times the caliber diameter D. Such a formation of the fin-stabilized mortar grenade 1 guarantees great ranges and, through the fashioning of the ogival shell body, a positive cooperation with the sealing ring for the reliable sealing of the propellant gases flowing against the ring 11 when the shell 1 passes through barrel 9.

The formation of the sealing arrangement on the fin-stabilized mortar grenade 1 facilitates and improves the access of propellant gases to the underside of the sealing ring. The propellant gases press sealing ring 11 against the opposite side surface of annular groove 10. The hitherto existing constructional form of known sealing rings included a rectangular cross section, and it was more or less left to chance whether the propellant gases could get to the underside of such a known sealing ring to such an extent that the sealing ring would be lifted out of the groove through a spreading action. With such a prior art sealing ring, there was at least an indeterminate delayed action so that the propellant gases could penetrate forwardly of groove 10. In so doing, a component force was operative against the spreading of the prior art sealing ring.

With the use of edge bevelling at the side of sealing ring 11 facing the propellant gases in accordance with the invention, the gases are directed on a course which enables them to get under the sealing ring 11 quickly and without delay. Consequently, sealing ring 11 is immediately spread by propellant gases first flowing thereagainst and lifted out of groove 10. The sealing ring can take over the sealing of shell body 2 with respect to inside wall 18 of barrel 9 immediately after the propellant gases flow thereagainst and thus effect the efficient sealing of the shell body 2 to the rear in the barrel 9. In this way, the discharge energy resulting from the propellant gases is used in its entirety and undiminished for discharging the shell out of barrel 9. With the sealing ring 11 having an edge bevel at the side facing toward the forward shell body portion, an action of the propellant gases on the underside of the sealing ring 11 arises from both sides thereof. This contributes to sustaining the spreading action of sealing ring 11.

The disposition of the annular groove 11 in the rear of caliber diameter zone 8 in combination with the sealing ring 11 requires the propellant gases which may pass sealing ring 11 to not get directly to the ogival body which slopes off at the front of the shell body portion 2, but must first of all traverse a very narrow clearance space. Consequently, an instantaneous drop in pressure for the propellant gases at the forward portion of shell body 2 cannot occur. This contributes to the very effective sealing of shell 1 at barrel 9 by means of sealing ring 11. The plurality of annular grooves disposed at the rear of the cylindrical caliber diameter zone 8 additionally induce a turbulence and accumulation effect of the arriving propellant gases.

While the Fin-Stabilized Mortar Grenade has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A fin-stabilized mortar grenade comprising:

(a) an ogival body and a tail section having fin controlling surfaces, (b) said body including a caliber diameter zone having at least one annular groove located therein, (c) a spreadable sealing ring disposed within said annular groove, (d) said sealing ring having an outside surface facing outwardly from said body, an inside surface facing the bottom of the annular groove and an edge bevel side surface extending outwardly a predetermined depth from said inside facing surface and disposed on the side of the sealing ring between the outside and inside surfaces and facing the rear of the shell body, (e) said sealing ring includes a separation plane passing obliquely therethrough, (f) said separation plane being at an angle of about 3° to 6° with respect to a principal plane of the ring which is perpendicular to the longitudinal axis of the ring, (g) the sealing ring includes a further edge bevel side surface located between the outside and inside surfaces at the side thereof facing toward the forward portion of said shell body, and (h) the inside surface of the ring and the bottom of the annular groove are both cylindrical, (i) said sealing ring includes cross slots peripherally spaced along the inner side of the sealing ring, (j) said cross slots having a depth corresponding to the extent of the ring thickness equal to the predetermined depth of said edge bevel surfaces, and (k) said cross slots being effective to facilitate flow of propellant gases from the rear facing side to the forward facing side of the body portion.

2. A mortar grenade as defined in claim 1 wherein the annular groove includes an inclined lateral face extending from the bottom of the groove to the rear portion of said shell body, said bottom of the groove has a width that is broader than the overall width of the sealing ring.

3. A mortar grenade as defined in claim 1 wherein the annular groove is located in the rear portion of the caliber diameter zone, said caliber diameter zone being cylindrical and disposed in the forward portion of said shell body.

4. A mortar grenade as defined in claim 1 wherein the edge bevel surface extends over about half the thickness of the sealing ring.

5. A mortar grenade as defined in claim 1 wherein said edge bevels extend at an angle with respect to a direction normal to the axis of the mortar grenade of about 45° and over about half the thickness of the ring with the cylindrical inside surface remaining on the sealing ring between said edge bevels.

* * * * *